US011149390B2

(12) United States Patent
Nelson

(10) Patent No.: US 11,149,390 B2
(45) **Date of Patent: *Oct. 19, 2021**

(54) PREFABRICATED, PRESTRESSED BRIDGE MODULE

(71) Applicant: Valmont Industries, Inc., Omaha, NE (US)

(72) Inventor: Guy C. Nelson, Byron Center, MI (US)

(73) Assignee: Valmont Industries, Inc., Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/934,611

(22) Filed: Jul. 21, 2020

(65) Prior Publication Data

US 2020/0354905 A1 Nov. 12, 2020

Related U.S. Application Data

(63) Continuation of application No. 15/813,423, filed on Nov. 15, 2017, now Pat. No. 10,895,047.

(Continued)

(51) Int. Cl.
*E01D 19/00* (2006.01)
*E01D 19/12* (2006.01)

(Continued)

(52) U.S. Cl.
CPC ..... *E01D 19/12* (2013.01); *E01D 2/00* (2013.01); *E01D 2/02* (2013.01); *E01D 19/125* (2013.01);

(Continued)

(58) Field of Classification Search
CPC ..... E01D 2/00; E01D 19/00; E01D 19/12; E01D 19/125

(Continued)

(56) References Cited

U.S. PATENT DOCUMENTS 1,656,197 A 1/1928 Henderson
1,890,432 A 12/1932 Billner (Continued)

FOREIGN PATENT DOCUMENTS

WO 2004101892 A1 11/2004

OTHER PUBLICATIONS

Shun-Ichi Nakamura, "Bending Behavior of Composite Girders with Cold Formed Steel U Section," Journal of Structural Engineering, Sep. 2002, pp. 1169-1176.

(Continued)

*Primary Examiner* — Gary S Hartmann
(74) *Attorney, Agent, or Firm* — Price Heneveld LLP

(57) ABSTRACT

A method for making a prefabricated, prestressed module includes arranging one or more steel beams atop a supporting formwork element in a direction transverse to the supporting formwork element and arranging one or more precast deck elements across the one or more steel beams to create a substantially continuous surface. The one or more precast deck elements have pockets for receiving connectors that protrude from the one or more steel beams. The method also includes arranging the supporting formwork element to allow the one or more steel beams to bend into a cambered shape to impart compressive stresses to a bottom flange of the one or more steel beams and tension stresses to a top flange of the one or more steel beams and inserting grout into the pockets to hold the cambered shape and to bond the one or more precast deck elements to the connectors and the top flange.

20 Claims, 9 Drawing Sheets

Related U.S. Application Data

(60) Provisional application No. 62/422,645, filed on Nov. 16, 2016.

(51) Int. Cl.

| | |
|---|---|
| ***E01D 2/02*** | (2006.01) |
| ***E01D 2/00*** | (2006.01) |
| *E01D 21/00* | (2006.01) |
| *E01D 101/32* | (2006.01) |
| *E01D 101/24* | (2006.01) |
| *E01D 101/26* | (2006.01) |

(52) U.S. Cl.
CPC ..... *E01D 19/00* (2013.01); *E01D 21/00* (2013.01); *E01D 2101/24* (2013.01); *E01D 2101/268* (2013.01); *E01D 2101/32* (2013.01)

(58) Field of Classification Search
USPC ..... 14/73, 73.1, 74.5, 77.1
See application file for complete search history.

(56) References Cited

U.S. PATENT DOCUMENTS

| | | | | |
|---|---|---|---|---|
| 1,912,290 | A | 5/1933 | Marks | |
| 2,064,788 | A | 12/1936 | Faber | |
| 2,308,943 | A | 1/1943 | Tietig et al. | |
| 2,373,072 | A | 4/1945 | Wichert | |
| 2,382,139 | A | 8/1945 | Cueni | |
| 3,327,028 | A | 6/1967 | Rosenblatt | |
| 3,473,273 | A | 10/1969 | Gunkel | |
| 3,566,557 | A | 3/1971 | Comolli | |
| 3,566,558 | A | 3/1971 | Fisher | |
| 3,794,433 | A | 2/1974 | Schupack | |
| 3,812,636 | A | 5/1974 | Albrecht et al. | |
| 3,944,242 | A | 3/1976 | Eubank | |
| 4,129,917 | A | 12/1978 | Sivachenko et al. | |
| 4,301,565 | A | 11/1981 | Weinbaum | |
| 4,493,177 | A | 1/1985 | Grossman | |
| 4,604,841 | A | 8/1986 | Barnoff et al. | |
| 4,646,493 | A | 3/1987 | Grossman | |
| 4,700,516 | A | 10/1987 | Grossman | |
| 4,709,456 | A | 12/1987 | Iyer | |
| 4,710,994 | A | 12/1987 | Kishida et al. | |
| 4,809,474 | A | 3/1989 | Ekberg, Jr. | |
| 4,972,537 | A | 11/1990 | Slaw, Sr. | |
| 5,144,710 | A | 9/1992 | Grossman | |
| 5,305,575 | A | 4/1994 | Grossman | |
| 5,311,629 | A | 5/1994 | Smith | |
| 5,471,694 | A | 12/1995 | Meheen | |
| 5,603,134 | A | 2/1997 | Whipkey et al. | |
| 5,617,599 | A | 4/1997 | Smith | |
| 5,644,890 | A | 7/1997 | Koo | |
| 5,771,518 | A | 6/1998 | Roberts | |
| 5,802,652 | A | 9/1998 | Smith | |
| 5,950,390 | A | 9/1999 | Jones | |
| 5,966,764 | A | 10/1999 | Vodicka | |
| 5,978,997 | A | 11/1999 | Grossman | |
| 5,987,680 | A | 11/1999 | Sakaya | |
| 6,065,257 | A | 5/2000 | Nacey et al. | |
| 6,081,955 | A | 7/2000 | Dumlao et al. | |
| 6,170,105 | B1 | 1/2001 | Doyle et al. | |
| 6,381,793 | B2 | 5/2002 | Doyle et al. | |
| 6,412,132 | B1 | 7/2002 | Majnaric et al. | |
| 6,434,893 | B1 | 8/2002 | Quenzi | |
| 6,467,223 | B1 | 10/2002 | Christley | |
| 6,539,571 | B1 | 4/2003 | Forsyth | |
| 6,708,362 | B1 | 3/2004 | Allen | |
| 6,915,615 | B2 | 7/2005 | Won | |
| 7,600,283 | B2 | 10/2009 | Nelson | |
| 7,627,921 | B2 | 12/2009 | Azizinamini | |
| 7,861,346 | B2 | 1/2011 | Wilson | |
| 8,234,738 | B2 | 8/2012 | Aumuller | |
| 8,321,985 | B2 | 12/2012 | Newton | |
| 8,448,280 | B2 | 5/2013 | Aumuller et al. | |
| 9,915,045 | B1 | 3/2018 | Azizinamini | |
| 10,161,090 | B2 | 12/2018 | Lee | |
| 10,323,368 | B2 | 6/2019 | Mullaney et al. | |
| 10,718,094 | B1 | 7/2020 | Nelson | |
| 10,895,047 | B2 * | 1/2021 | Nelson | E01D 2/00 |
| 2001/0039773 | A1 | 11/2001 | Bot | |
| 2003/0182338 | A1 | 9/2003 | Yamamoto et al. | |
| 2003/0182883 | A1 | 10/2003 | Won | |
| 2004/0040233 | A1 | 3/2004 | Park | |
| 2004/0118066 | A1 | 6/2004 | DeLoach, Sr. | |
| 2004/0216249 | A1 | 11/2004 | El-Badry | |
| 2005/0115195 | A1 | 6/2005 | Bettigole et al. | |
| 2005/0283926 | A1 | 12/2005 | Pollard et al. | |
| 2009/0121112 | A1 | 5/2009 | Clark et al. | |
| 2018/0135261 | A1 * | 5/2018 | Nelson | E01D 2/00 |
| 2019/0276994 | A1 | 9/2019 | Dagher et al. | |
| 2020/0131754 | A1 * | 4/2020 | Heatly | E04C 2/06 |
| 2021/0017722 | A1 * | 1/2021 | Stancescu | E01D 2/00 |

OTHER PUBLICATIONS

Inverset Bridge System, J.W. Peters and Sons, Inc., Highway Products Division, 1998.

Inverset Bridge System, "Tappen Zee Bridge, Hudson River, New York," Jul. 21, 1997.

Inverset Bridge System, "Design, Installation, Technical Manual," J.W. Peters and Sons, Inc.

Commonwealth of Pennsylvania, Department of Transportation, "Research Project No. 92-056, 'Inverset' Bridge Deck Evaluation," Final Report, Jan. 1997, Brian St. John and Marcella Jo Lucas.

Rigoberto Burgueno, Ph.D., "Evaluation of Prefabricated Composite Steel Box Girder Systems for Rapids Bridge Construction," 1st Quarterly Report to the Michigan Department of Transportation, May 3, 2006, pp. 1-39, East Lansing, Michigan.

CDR Bridge Systems, www.cdrbridges.com.

Office action dated Aug. 25, 2020, Notice of References Cited, and Information Disclosure Statement by Applicant from Valmont Industries' pending U.S. Appl. No. 16/933,360.

* cited by examiner

SECTION A-A

SECTION A-A

SECTION B-B

SECTION C-C

SECTION B-B

SECTION D-D

SECTION D-D

SECTION B-B

SECTION D-D

PREFABRICATED, PRESTRESSED BRIDGE MODULE

CROSS-REFERENCE TO RELATED APPLICATION

This patent application is a continuation of U.S. patent application Ser. No. 15/813,423, filed on Nov. 15, 2017, entitled "PREFABRICATED, PRESTRESSED BRIDGE MODULE", now U.S. Pat. No. 10,895,047, issued on Jan. 21, 2021, which claimed priority to and the benefit under 35 U.S.C. § 119(e) of the U.S. Provisional Patent Application No. 62/422,645, filed Nov. 16, 2016, entitled "BRIDGE CONSTRUCTION USING ULTRA-HI-PERFORMANCE MATERIALS", the entire disclosures of which are incorporated herein.

FIELD OF THE DISCLOSURE

This disclosure relates to a prefabricated, prestressed bridge system and a method for making same.

BACKGROUND OF THE DISCLOSURE

This disclosure relates to a prefabricated, prestressed bridge system and a method for making same. Prefabricated, prestressed bridges are commonly known, however, the prefabricated, prestressed bridges currently available are cumbersome to manufacture and difficult to erect resulting in an expensive, labor-intensive final product. Prefabricated, prestressed bridges are used in a variety of civil engineering applications such as disclosed in U.S. Pat. No. 5,471,694 Prefabricated Bridge with Prestressed Elements ("Meheen patent"); U.S. Pat. No. 4,493,177 Composite, Pre-Stressed Structural Member and Method for Forming Same ("Grossman patent"); and U.S. Pat. No. 2,373,072 Rigid Frame Bridge and Method of Making the Same ("Wichert patent"). However, improvements are desired to use new construction materials, provide a more easily manufacturable, more robust system with more standardized components which assist in providing the prestress to the bridge beams. Implementation of these improvements results in lower cost and increased speed of construction of a prefabricated, prestressed bridge system.

The Meheen patent discloses a prefabricated bridge beam with prestressed elements comprising a rectangular girder-box assembly which includes a bottom plate prestressed in compression and a pair of upstanding side members each having its upper portions prestressed in tension. A poured and cured bridge deck is supported by the said side members, the cured deck securing in place the said tension and compression stresses.

The Grossman patent discloses a composite, prestressed structural member comprised of concrete and a lower metal support member, and a method for forming and prestressing the same.

The Wichert patent relates to rigid frame bridges and the fabrication and construction thereof. The Wichert method for fabricating the rigid frame bridge discloses holding the metal span portion of the bridge against sagging upon application of the concrete or, alternatively, positively pressing upwardly the metal span portion prior to pouring the concrete.

BRIEF SUMMARY OF THE DISCLOSURE

According to one aspect of the present disclosure, a method for making a prefabricated, prestressed module includes the steps of arranging one or more steel beams atop a supporting formwork element in a direction transverse to the supporting formwork element. The method further includes arranging one or more precast deck elements across the one or more steel beams to create a substantially continuous surface wherein the one or more precast deck elements have pockets for receiving connectors that protrude from the one or more steel beams. The method further includes arranging the supporting formwork element to allow the one or more steel beams to bend into a cambered shape to impart compressive stresses to a bottom flange of the one or more steel beams and tension stresses to a top flange of the one or more steel beams. The method also includes inserting grout into the pockets to hold the cambered shape and to bond the one or more precast deck elements to the connectors and the top flange.

According to another aspect of the present disclosure, a prefabricated, prestressed bridge module includes one or more precast deck elements arranged across one or more steel beams. The one or more steel beams are arranged on three or more supporting formwork elements such that the first supporting formwork element is at a first outer end of the one or more steel beams, the second supporting formwork element is at a middle of the one or more steel beams, and the third supporting formwork element is at a second outer end of the one or more steel beams. The one or more precast deck elements include pockets for receiving connectors that protrude from the one or more steel beams. At least one of the three or more supporting formwork elements is adjusted to stress the one or more steel beams. Grout is inserted in the pockets to bond the one or more precast deck elements to the one or more steel beams and the connectors such that a resulting compression stress of the one or more precast deck elements and the grout secures in place the stresses imparted to the one or more steel beams.

According to yet another aspect of the present disclosure, a prefabricated, prestressed bridge-forming module includes one or more steel beams atop a supporting formwork element in a direction transverse to the supporting formwork element, and one or more precast deck elements across the one or more steel beams creating a substantially continuous surface, the one or more precast deck elements having connectors that extend between the one or more steel beams and the one or more precast deck elements. The supporting formwork element supports the one or more steel beams while bent into a cambered shape resulting in compressive stresses to a bottom flange of the one or more steel beams and tension stresses to a top flange of the one or more steel beams. Grout is disposed on the one or more steel beams and at least between adjacent precast deck elements of the one or more precast deck elements. The grout bonds the one or more precast deck elements together and maintains the cambered shape of the one or more steel beams.

According to yet another aspect of the present disclosure, a prefabricated, prestressed bridge-forming module includes one or more cambered steel beams, and a plurality of precast deck elements disposed across the one or more cambered steel beams creating a substantially continuous surface. The one or more precast deck elements have pockets for receiving connectors that protrude from a top flange from each cambered steel beam. Grout is disposed in the pockets. The grout holds the cambered steel beams in a cambered shape and bonds the one or more precast deck elements to the connectors and the top flange of the cambered steel beams.

The present disclosure includes a novel prefabricated, prestressed bridge system and method for making same. The prefabricated, prestressed bridge system can be used in a variety of construction applications including, but not limited to, bridge applications. The prefabricated, prestressed bridge system includes one or more prefabricated, prestressed bridge modules fabricated from different prefabricated elements of varying strengths and modulus of elasticity. The different materials used for the elements are designed to minimize the material quantities of each specific element, minimize the fabrication duration, maximize the strength of the final products and meet any specific need of the final prefabricated, prestressed bridge system.

In one aspect of the present disclosure, a method for making the prefabricated, prestressed bridge module comprises providing and arranging one or more steel beams on three or more supporting formwork elements such that the first supporting formwork element is at a first outer end of the one or more steel beams, the second supporting formwork element is at the middle of the one or more steel beams, the third supporting formwork element is at a second outer end of the one or more steel beams, and the additional formwork elements are at one or more intermediary locations between the first outer end and the middle of the one or more steel beams and at one or more intermediary locations between the second outer end and the middle of the one or more steel beams. The method further comprises welding shear connectors to the top flanges of the one or more steel beams, adjusting the height of one or more of the supporting formwork elements to allow bending of the one or more steel beams under the self-weight, weight of the precast concrete deck elements and an externally applied load, placing and connecting the precast concrete deck elements by means of, for example, an ultra-high performance cementitious grout with a compressive strength of at least 14,500 psi and modulus of elasticity of at least 6,300 ksi placed into pockets in the precast deck elements aligned with and containing the welded shear studs and also placed atop the precast concrete deck elements to form a concrete surface bonded to the top of the precast concrete deck panels, such that the resulting compression stress of the concrete deck and overlay secure in place the stresses imparted to the one or more steel beams and creates a completed module having an increased load carrying capacity with less material and at a reduced cost as compared with current practice.

Grout can be in the form of HPC (High Performance Concrete), UHPC (Ultra High Performance Concrete), or other similar cementious material. The grout can be an overlay and can be limited to between the precast deck elements.

Each prefabricated, prestressed bridge module comprising of one or more steel beams, shear connectors attached to the one or more steel beams, and connecting the precast concrete deck elements to the beams to form a surface atop the beams, then forms a prefabricated, prestressed bridge system comprising two or more prefabricated, prestressed bridge modules secured together with ultra-high performance concrete joints is also a subject of the present disclosure.

Accordingly, an object of the present disclosure is to provide a prefabricated, prestressed bridge module in which camber is produced by selectively varying the heights of supporting formwork elements under the bridge module components while the prefabricated, prestressed bridge module is being made. Alternatively, camber may be achieved by selectively raising one or more supporting formwork elements under the bridge module components while the prefabricated, prestressed bridge module is being made.

It is an additional object of this disclosure to provide a prefabricated, prestressed bridge module which utilizes the weight of precast deck panels placed atop the beams in combination with the adjustment of supporting formwork elements to produce camber.

It is an additional object of this disclosure to provide a prefabricated, prestressed bridge module which uses the weight of deck panels placed atop the beams, the varying height supporting formwork elements, and an externally applied load to produce camber.

It is an additional object of this disclosure to provide a prefabricated, prestressed bridge module which uses the weight of deck panels placed atop the beams, the varying height supporting formwork elements, to produce camber in the steel beam that is secured in place with a shear connection between the deck panels and steel beams.

It is an additional object of this disclosure to provide a prefabricated, prestressed bridge module which uses precast concrete deck panels placed atop high density polyethylene shims with compressive strength of at least 40 psi which are placed atop the top flanges of the steel beams which allow for an annular space between the precast deck panel and steel beams.

It is an additional object of this disclosure to provide a prefabricated, prestressed bridge module which uses precast concrete deck panels placed atop the beams that are secured in place with shear connections between the deck panels and steel beams comprising of cementitious grout bonded to the top of the steel beams and bottom of the concrete deck panels.

It is an additional object of this disclosure to provide a prefabricated, prestressed bridge module which uses precast concrete deck panels placed atop the steel beams that are secured in place with cementitious grout placed in the annular void between the steel beams and the precast deck panels.

It is an additional object of this disclosure to provide a prefabricated, prestressed bridge module which uses precast concrete deck panels placed atop the beams that are secured in place with shear connections between the deck panels and steel beams comprising of cementitious grout being integrally placed with an overlay surface atop the precast concrete deck panels.

It is an additional object of the disclosure to provide a prefabricated, prestressed bridge module which utilizes steel beams that are trapezoidal-shaped, I-beam-shaped, or shaped like other steel beams commonly used in the civil engineering industry.

It is an additional object of the disclosure to provide a prefabricated, prestressed bridge system that is faster to make, more efficient to fabricate, faster to install and more affordable than other prefabricated, prestressed bridges.

It is an additional object of the disclosure to provide a prefabricated, prestressed bridge system that consists of one or more prefabricated, prestressed bridge modules that can be joined with one another to make prefabricated, prestressed bridge systems of various sizes.

It is an additional object of the disclosure to provide a method of making a prefabricated, prestressed bridge system that can be made in a first location and delivered to a second location for installation and use.

It is an additional object of the disclosure to provide a method of making a prefabricated, prestressed bridge system in which the components can be manufactured in separate locations and delivered to a common location for assembly, installation and use.

An additional object of the disclosure is to provide a prefabricated, prestressed bridge system that can serve as a prefabricated, prestressed beam that can be used in a variety of construction applications, including but not limited to bridge applications.

It is an additional advantage of utilizing connections between modules with ultra-high performance concrete and making them more economical, faster to fabricate, and easier to install.

An additional advantage of this disclosure is a modular system which is lighter in weight than other systems, can be fabricated in a location other than its final use and easily moved and installed in its final location.

It is an additional object of the disclosure to provide shear force transfer from the beam's elements to the deck panel elements that utilizes roughened surfaces on top of the beams and bottom of the deck panels which are then bonded with ultra-high performance concrete.

The principle objective of the disclosure is to provide a more economical bridge system, with an improved configuration that allows the final bridge element to have a longer service life than current conventional materials and procedures.

Another objective of this disclosure is to provide a method for making the bridge element which reduces the in place stresses imparted to each individual element.

It is an additional object of the disclosure to provide a geometric configuration that utilizes and economizes the properties of the specific materials used to fabricate the bridge.

It is an additional object of the disclosure to provide a protective coating of the beam elements that enables the bridge to have an even longer service life in environments typically encountered.

It is an additional object of the disclosure to utilize cold formed steel which has the advantage of reduced cost over current fabrication of steel girders.

Another advantage is the ease of construction installation that speeds installation and reduces end-user delays when compared with current practice.

Another objective is to utilize newly developed cementitious materials to further ease fabrication and speed installation.

The present innovations are improvements (and have advantages) over known similar bridge systems such as shown in Nelson U.S. Pat. No. 7,600,283 "Prefabricated, Prestressed Bridge System and Method of Making Same," including at least the following:

The UHPC overlay provides approximately an additional 40 years of maintenance free service life to the bridge deck surface (longer service life, lower life cycle costs).

The UHPC overlay allows for thinner precast concrete deck panels (less concrete material, shallower overall depth of module).

The UHPC fill in the precast concrete panel voids allows for larger spacing of the welded shear connectors (less shear connector material, lower cost).

The top of the precast concrete deck panels will have a roughened surface with and amplitude of at least ¼" so that the UHPC overlay will bond to the precast concrete panel and provide additional stiffness to the bridge module (shallower overall depth of module).

The UHPC overlay is extremely dense and impermeable giving further protection and longer service life to the underlying precast concrete deck panel (longer service life, lower life cycle costs).

The UHPC placed into the annular space between the top of the steel beams and the bottom of the precast concrete deck panel provides additional bonding and shear resistance further strengthening the final bridge module (this option would eliminate shear connectors, lower cost).

The UHPC overlay places an extremely stiff, dense and impermeable layer at the top extreme fiber of the bring module allowing for shallower modules, which is a benefit not only for decreased weight in shipping, but increase clearance for bridges and less tall structures for buildings (shallower overall depth of module).

The use of precast concrete deck panels (rather than casting wet concrete on steel beam) allows for flexibility of the fabrication process. Material can be allocated and manufactured in parallel rather than in series (faster fabrication, lower cost).

The use of the weight of the precast concrete deck panels for providing camber in the steel beams allows for the elimination of backwalls and intermediate diaphragms (faster fabrication, lower cost).

The use of UHPC in the joint to connect individual modules increases the load carrying capacity of the joint, reduces the width of the joint, speed of the installation of the modules and allows for the connected modules to support load sooner (faster installation, reduced material).

These and other features, advantages, and objects of the present disclosure will be further understood and appreciated by reference to the following specification, claims, and appended drawings.

DETAILED DESCRIPTION

Figure 1:
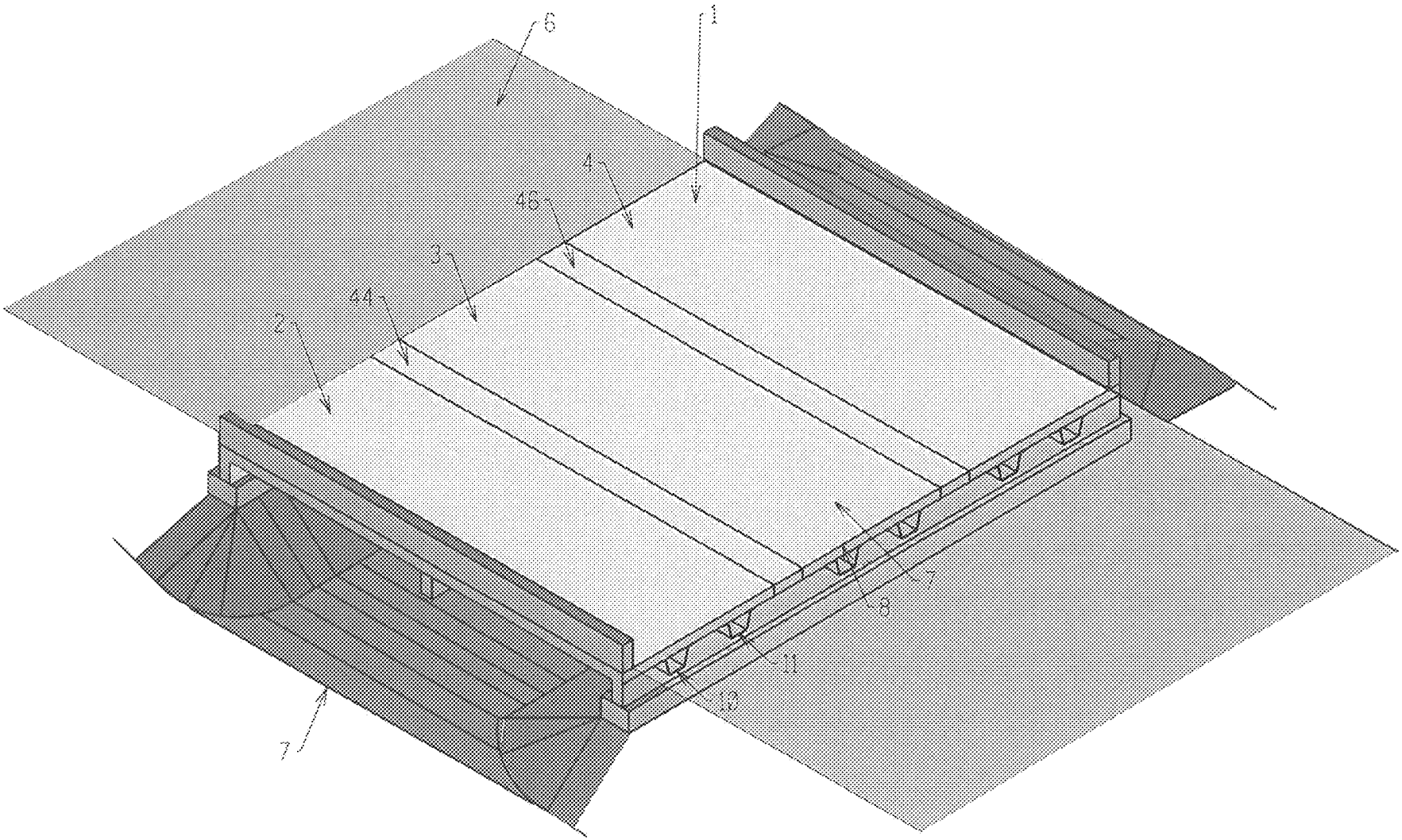
FIG. 1 is a perspective view of a bridge embodying an aspect of the prefabricated, prestressed bridge system of the present disclosure.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary aspects of the inventive concepts defined in the appended claims. Hence, specific dimensions and other physical characteristics relating to the aspects disclosed herein are not to be considered as limiting, unless the claims expressly state otherwise.

Figure 3:
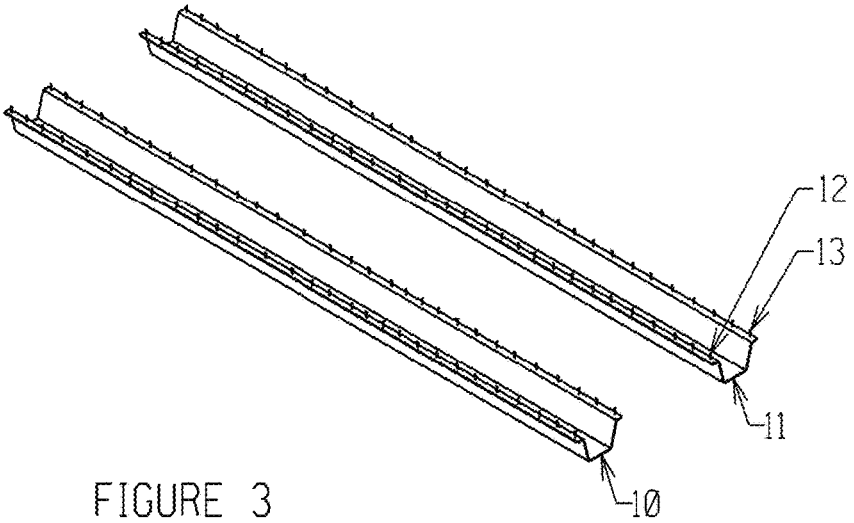
FIG. 3 is a perspective view of the beams with shear connectors used in FIG. 1 of an aspect of the disclosure.
Figure 4:
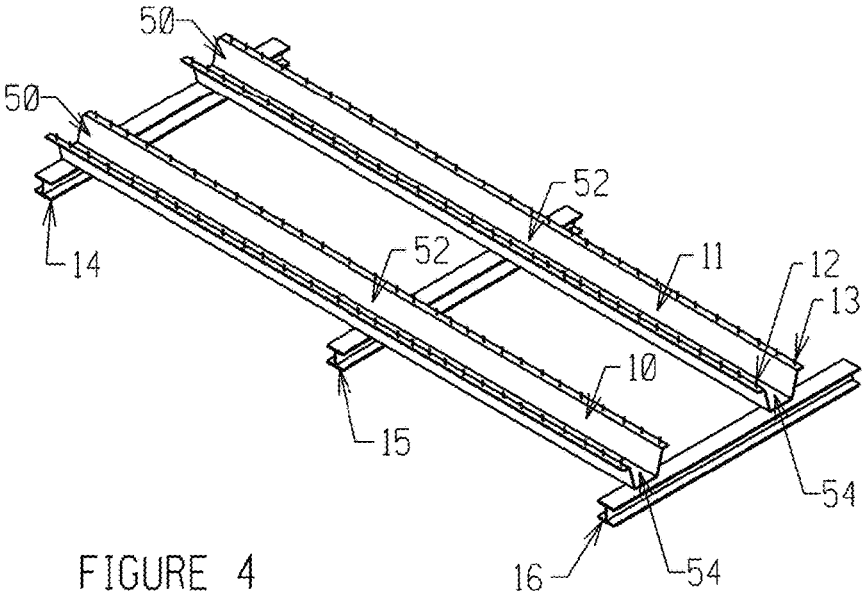
FIG. 4 is a perspective view of the steel beams, shear connectors, and supporting formwork elements used in FIG. 1 of an aspect of the disclosure.
Figure 5:
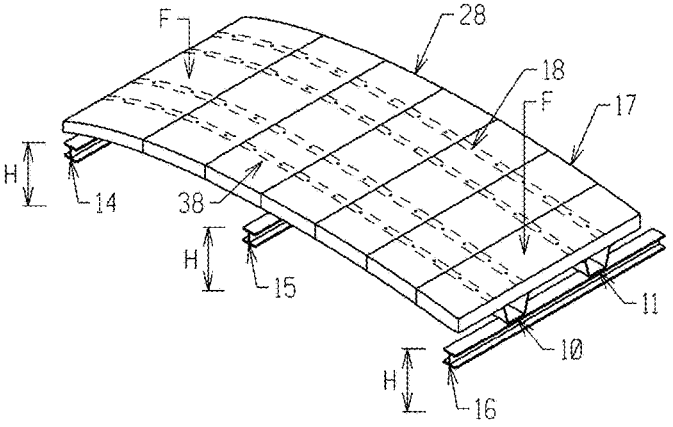
FIG. 5 is a perspective view of the steel beams and supporting formwork elements with precast concrete deck elements placed atop the steel beams in a camber-producing arrangement of an aspect of the disclosure, shown with the camber exaggerated.
Figure 5A:
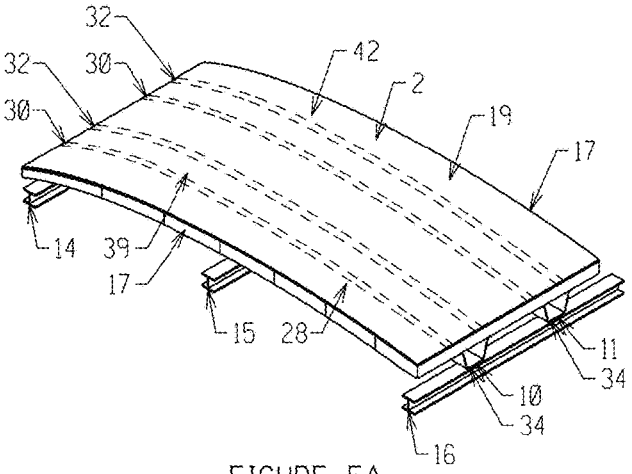
FIG. 5A is a perspective view of the steel beams, supporting formwork elements, and precast concrete deck elements atop the steel beams in a camber-producing arrangement with a cementitious grout placed in pockets and atop the precast deck elements of an aspect of the disclosure, shown with the camber exaggerated.

With reference to FIGS. 1 and 3-9, a method for making a prefabricated, prestressed module 2 includes the steps of arranging one or more steel beams 10, 11 atop a supporting formwork element 15 in a direction transverse to the supporting formwork element 15. The method also includes arranging one or more precast deck elements 17 across the one or more steel beams 10, 11 to create a substantially continuous surface 38 wherein the one or more precast deck elements 10, 11 have pockets 18 for receiving connectors 12, 13 that protrude from the one or more steel beams 10, 11. The method also includes arranging the supporting formwork element 15 to allow the one or more steel beams 10, 11 to bend into a cambered shape 28 to impart compressive stresses to a bottom flange 34 of the one or more steel beams 10, 11 and tension stresses to a top flange 30, 32 of the one or more steel beams 10, 11. Further, the method includes inserting grout 36 into the pockets 18 to hold the cambered shape 28 and to bond the one or more precast deck elements 17 to the connectors 12, 13 and the top flange 30, 32. Referring to FIGS. 5 and 5A, the method for making a prefabricated, prestressed module 2 may further comprise applying a grout overlay 19 to the substantially continuous surface 38.

FIG. 1 is an overview of a bridge 1 constructed from the side-by-side combination of three prefabricated, prestressed modules 2, 3, and 4. The three prefabricated, prestressed modules 2, 3 and 4 comprise the prefabricated, prestressed bridge system 8. The bridge system 8 is a continuation of roadway 6, spanning a depression area shown generally at 7. Concrete joint 44 is between module 2 and module 3. Concrete joint 46 is between module 3 and module 4.

Figure 2:
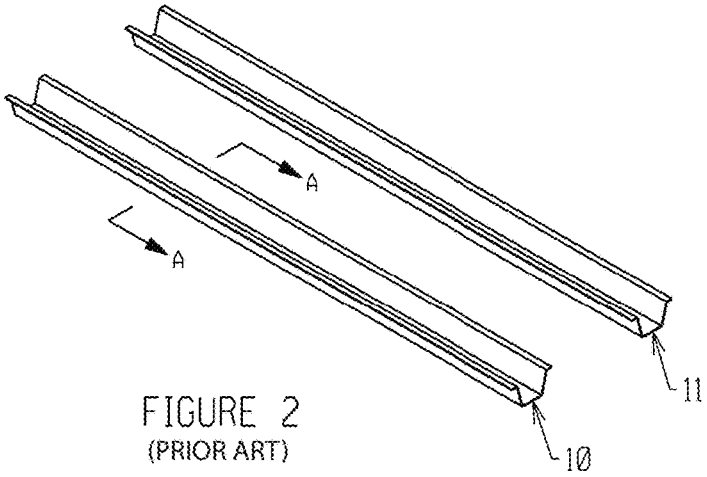
FIGURE 2 (PRIOR ART)
FIG. 2 is a perspective view of known prior art steel trapezoidal beams that can be incorporated within the device of FIG. 1 of an aspect of the disclosure.
Figure 2A:
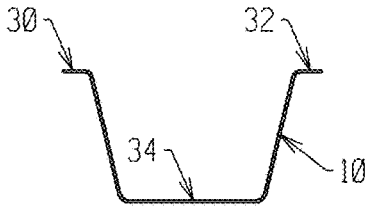
FIGURE 2A (PRIOR ART)
FIG. 2A is a cross-sectional view taken through one of the known prior art steel trapezoidal beams of FIG. 2.

FIGS. 3-6 depict stages of construction of prefabricated, prestressed modules 2, 3, and 4 shown in FIG. 1. FIG. 2 shows known prior art steel trapezoidal beams 10, 11 which can form the support for a prefabricated, prestressed module 2, 3, or 4. Steel beams 10, 11 are formed of steel plate bent into a trapezoidal "U" shape. FIG. 2A shows a cross-sectional view of the trapezoidal steel beams 10, 11. Trapezoidal beam 10 has top flanges 30, 32 and a bottom flange 34.

Figure 2B:
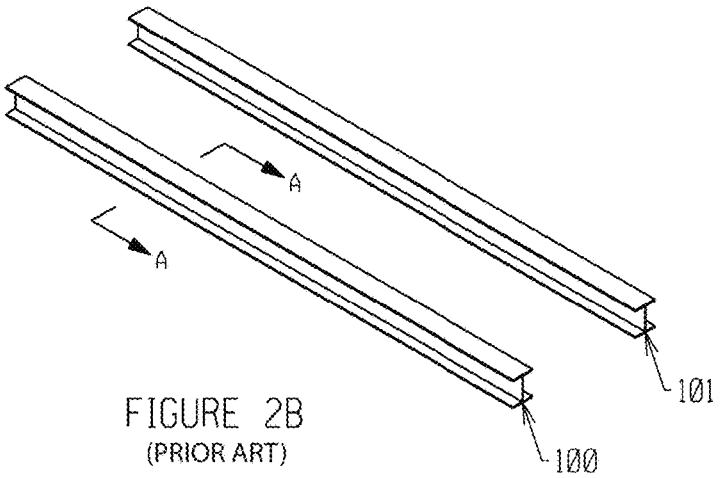
FIGURE 2B (PRIOR ART)
FIG. 2B is a perspective view of known prior art steel I-beams that can be incorporated within the device of FIG. 1 of an alternate aspect of the disclosure.
Figure 2C:
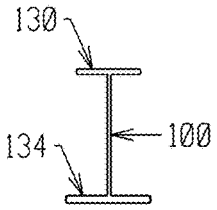
FIGURE 2C (PRIOR ART)
FIG. 2C is a cross-sectional view taken through one of the known prior art steel I-beams in FIG. 2B.

Referring to FIGS. 2B and 2C, in various aspects of the disclosure, one or more known prior art steel beams 100, 101 with an I-beam shape may be used in place of or in combination with one or more trapezoidal beams 10, 11. Referring to FIG. 2C, the I-beam 100 has a top flange 130 and a bottom flange 134.

Figure 3A:
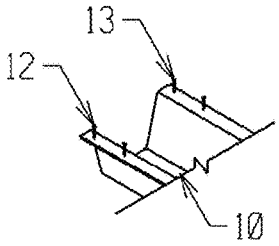
FIG. 3A is a first enlarged view of a steel beam with holes and shear connectors of FIG. 3.
Figure 3B:
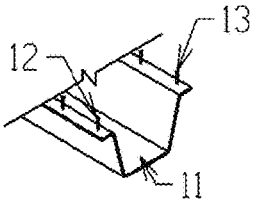
FIG. 3B is a second enlarged view of a steel beam with holes and shear connectors of FIG. 3.

FIG. 3 shows the steel beams 10, 11. FIG. 3A is an exploded view of the section of steel beam 10 and shows the shear connectors 12, 13 located on steel beam 10. FIG. 3B is an exploded view of the section of steel beam 11 with shear connectors 12, 13. In the depicted aspect, shear connectors 12, 13 are shear studs.

FIG. 4 shows the steel beams 10, 11 placed atop supporting formwork elements 14, 15, and 16. Supporting formwork element 14 is the first supporting formwork element, and it is at the first outer end 50 of the steel beams 10, 11. Supporting formwork element 15 is the second supporting formwork element, and it is at the middle 52 of the steel beams 10, 11. Supporting formwork element 16 is the third supporting formwork element, and it is at the second outer end 54 of the steel beams 10, 11. Though the supporting formwork elements 14, 15, and 16 are depicted in what is known as the I-beam shape in FIG. 4, the trapezoidal "U" shape construction of FIGS. 2 and 2A, and/or supporting formwork of another shape known in the construction industry may be used. In the ideal case, each supporting formwork element 14, 15, and 16 sits on a flat surface that is level with the surface of the other two supporting formwork elements.

FIG. 5 shows the novel method of prestressing the prefabricated, prestressed bridge module by producing camber in the steel beams 10 and 11 utilizing weight from precast deck elements 17 placed atop steel beams 10, 11 and by varying the height H of the supporting formwork elements 14, 16 to allow the steel beams 10, 11 to bend under the weight of deck elements 17. Camber is defined as providing curvature in a beam opposite in direction to that corresponding to deflections of the beam under load. Alternatively, camber can be produced in the steel beams 10, 11 of the prefabricated, prestressed bridge module by raising the supporting formwork element 15 to vary the height H of the supporting formwork element 15 to allow the steel beams 10, 11 to bend under the weight of precast deck elements 17. The deck elements 17 are provided with open pockets 18 to allow for securing the deck elements to the steel beams 10, 11 through the use of cementitious grout 36. The pockets can include spaces between adjacent precast deck elements 17, the grout pockets 18 themselves, or both. Prestressing of the prefabricated, prestressed bridge module 2 to produce camber in the steel beams 10, 11 may be achieved using the weight of the deck elements 17 without the use of additional external loads. However, additional external loads may be utilized to aid in the production of additional camber. In an aspect of the disclosure, additional external loads F may be applied to the bridge module 2 to produce additional camber in the steel beams 10, 11.

Referring to FIGS. 5 and 5A, the precast concrete deck elements 17 provide a unique, efficient, cost-effective means to pre-camber the steel beams. When secured to the steel beams, the deck elements 17 and optional cementitious grout overlay 19 also serve to retain the stresses imparted to the one or more steel beams 10, 11, retain the cambered shape 28 and strengthen the bridge module 2. When the prefabricated, prestressed bridge module 2 is used alone or in combination with one or more prefabricated, prestressed bridge modules 3, 4, the deck elements 17 also distribute live loads that the prefabricated, prestressed bridge module 2 bears over the one or more steel beams.

The deck elements 17 and cementitious grout overlay 19 are an integral part of the prefabricated, prestressed structures of bridge module 2 that serve the additional function of producing and retaining camber in the one or more steel beams.

FIG. 5A shows an overlay 19 of cementitious grout 36 formed atop the deck elements 17, placed into the open pockets 18 in the deck elements 17 and atop the steel beams 10, 11. The concrete overlay 19 of cementitious grout 36 is placed after the supporting formwork elements 14, 15, and 16 are set at a level so that supporting formwork elements 14, 16 are at the same level with one another and so that supporting formwork elements 14, 16 are lower than the level of supporting formwork element 15. The overlay 19 of cementitious grout 36 can also be placed monolithically into the open pockets 18 in the concrete deck elements 17 shown in FIG. 5 to secure the deck elements 17 to the steel beams 10, 11. Depending on the length of the steel beams 10, 11, intermediary supports, in addition to the supporting formwork may be needed to support the stressed steel beams 10, 11. After the cementitious grout 36 of the prefabricated, prestressed bridge module 2 has cured, the prefabricated, prestressed bridge module 2 can be removed from the three supporting formwork elements 14, 15, and 16 and is ready for use as a bridge 1 by itself or as part of a prefabricated, prestressed bridge system 8.

Figure 6:
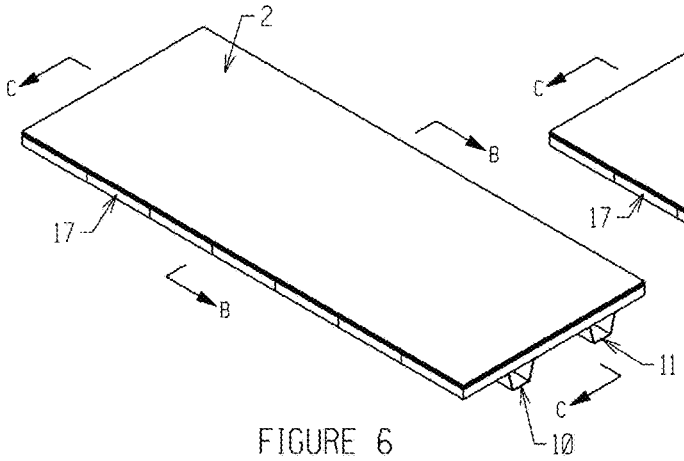
FIG. 6 is a perspective view of a completed prefabricated, prestressed bridge module used in FIG. 1 of an aspect of the disclosure.

FIG. 6 shows the prefabricated, prestressed bridge module 2 after the cementitious grout overlay 19 shown in FIG. 5A has cured and after the prefabricated, prestressed bridge module 2 has been removed from the supports 14, 15, and 16 shown in FIG. 4. The prefabricated, prestressed bridge module 2 is prestressed because the supporting formwork elements 14, 15, and 16 beneath the beams 10, 11 vary in height and result in bending of the one or more steel beams 10, 11 when the deck elements 17 are placed and secured to the beams 10, 11 with cementitious grout 36 and form a surface 38 on the one or more steel beams 10, 11 such that resulting compression stress of the deck elements 17 and overlay 19 secures in place the stresses imparted to the one or more steel beams 10, 11 to form a cambered configuration. The prefabricated, prestressed bridge module 2, shown in FIG. 6, can now be used in a prefabricated, prestressed bridge system 8 as a single module 2, or in conjunction with one or more modules 3 and/or 4, as shown in FIG. 1.

Figure 6D:
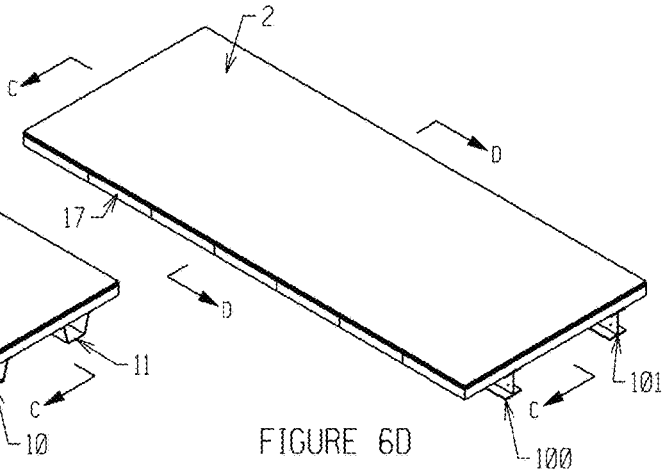
FIG. 6D is an alternate aspect of FIG. 6 wherein the steel beams are I-beams.
Figure 6A:
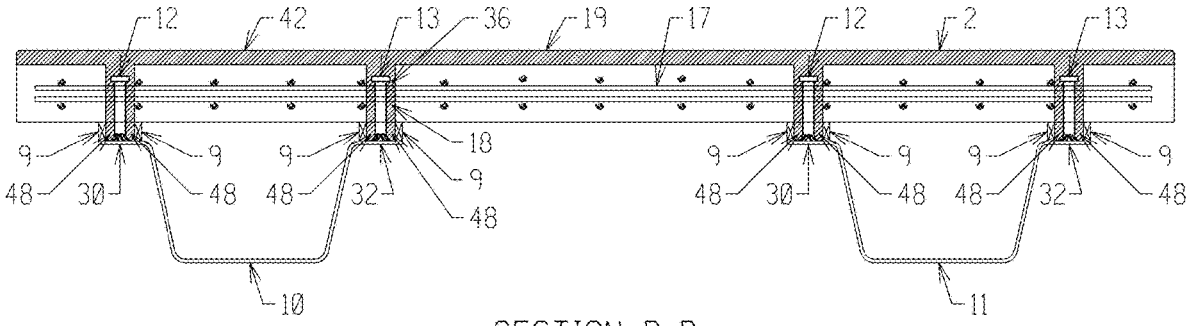
FIG. 6A is a cross-sectional view taken through B-B of FIG. 6 of the prefabricated, prestressed bridge module of FIG. 6 showing the precast concrete deck elements atop the shims and the cementitious grout atop the deck elements, within the grout pockets, and between the shims of an aspect of the disclosure.

FIG. 6A shows a first cross-sectional view of the prefabricated, prestressed bridge module 2 of FIG. 6 with shims 9. Shear connectors 12, 13 are welded on steel beams 10, 11. Precast concrete deck elements 17 are placed atop high density polystyrene shims 9 which have been placed atop the top flanges 30, 32 of the steel beams 10, 11. The precast concrete deck elements are connected by means of cementitious grout 36 placed into open pockets 18 in the precast concrete deck elements 17 which contain the shear connectors 12, 13. The cementitious grout 36 can also be placed as an overlay 19 monolithically when grouting the open pockets 18. Grout 36 is also in the annular space 48 between shims 9 and between the precast deck element 17 and the top flange 30, 32.

Figure 6B:
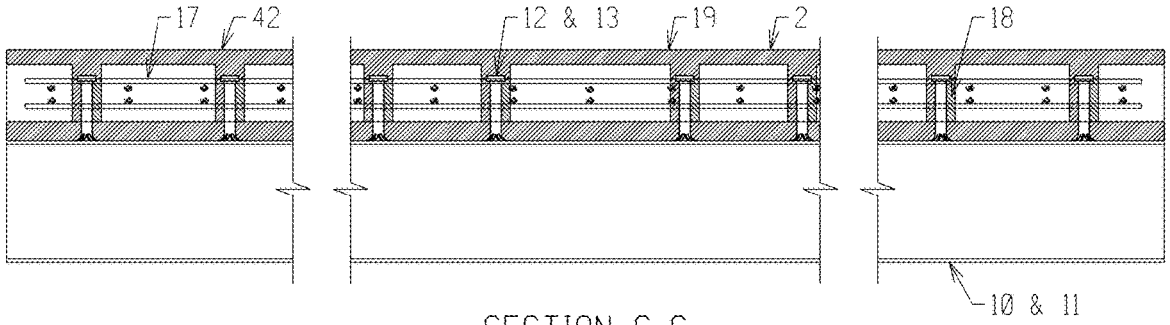
FIG. 6B is a cross-sectional view taken through C-C of the prefabricated, prestressed bridge module of FIG. 6 showing the precast concrete deck elements and the cementitious grout atop the deck elements, within the grout pockets, and between the shims of an aspect of the disclosure.

FIG. 6B shows a second cross-sectional view of the prefabricated, prestressed bridge module of FIG. 6. Shear connectors 12, 13 are welded on the steel beams 10, 11. Precast concrete deck elements 17 are atop the steel beams 10, 11 and connected by means of a cementitious overlay 19 and grouted pockets 18.

In combination with the self-weight of the steel beams 10, 11 atop the varying heights of the supporting formwork elements 14, 15, 16, the weight of the deck elements 17 stresses the one or more steel beams 10, 11 before the overlay 19 is cast atop the deck elements 17. The deck elements 17 and overlay 19 form a surface 39 atop the one or more steel beams 10, 11 such that resulting compression stress of the concrete deck 42 secures in place the stresses imparted to the one or more steel beams 10, 11 that maintain the cambered configuration of each module 2.

Figure 6C:
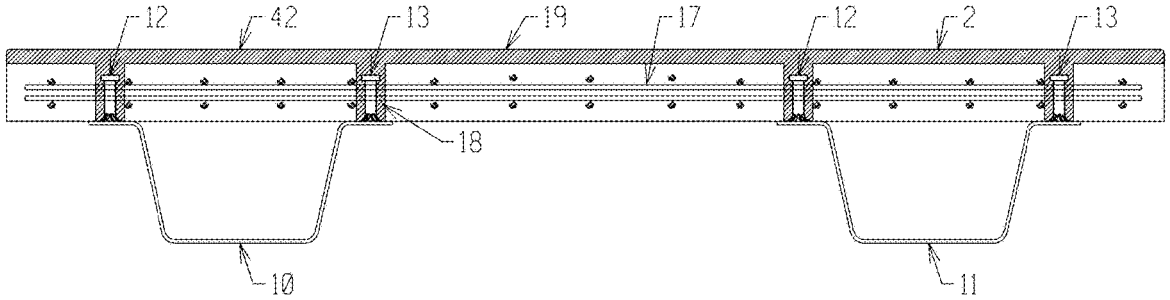
FIG. 6C is an alternate aspect of FIG. 6A wherein the cementitious grout is atop the deck elements and within the grout pockets.

FIG. 6C shows another aspect of the prefabricated, prestressed bridge module of FIG. 6. FIG. 6C shows the module 2 without shims 9.

Referring to FIG. 6D, an alternative aspect of the prefabricated, prestressed module 2 of FIG. 6 is shown. Steel beams 100, 101 are in I-beam shapes in FIG. 6D.

Figure 6E:
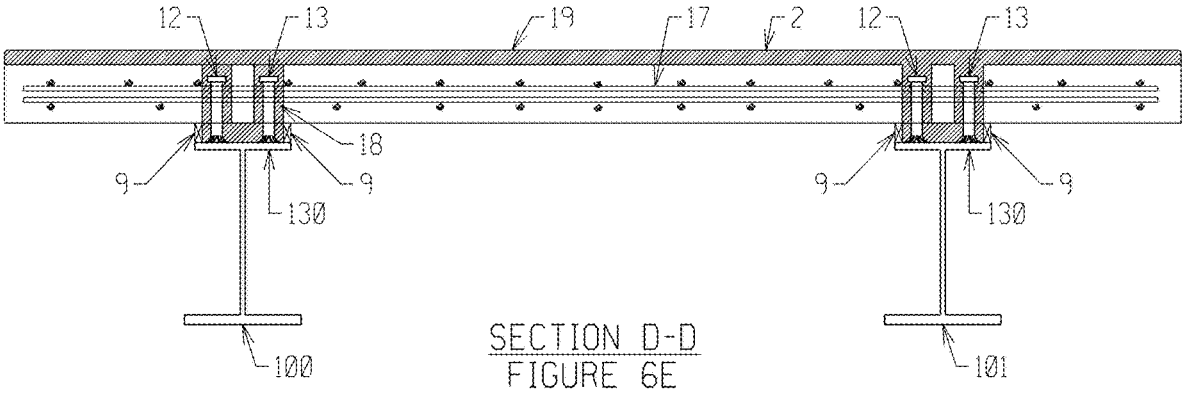
FIG. 6E is a cross-sectional view taken through D-D of FIG. 6D of the prefabricated, prestressed bridge module of FIG. 6D showing the precast concrete deck elements atop the shims and the cementitious grout atop the deck elements, within the grout pockets, and between the shims of an aspect of the disclosure.

Referring to FIG. 6E, a cross section of the prefabricated, prestressed module 2 with I-beam steel supports taken along D-D of FIG. 6D is shown. Shims 9 are between the top flanges 130 of I-beams 100, 101 and the precast deck element 17.

Figure 6F:
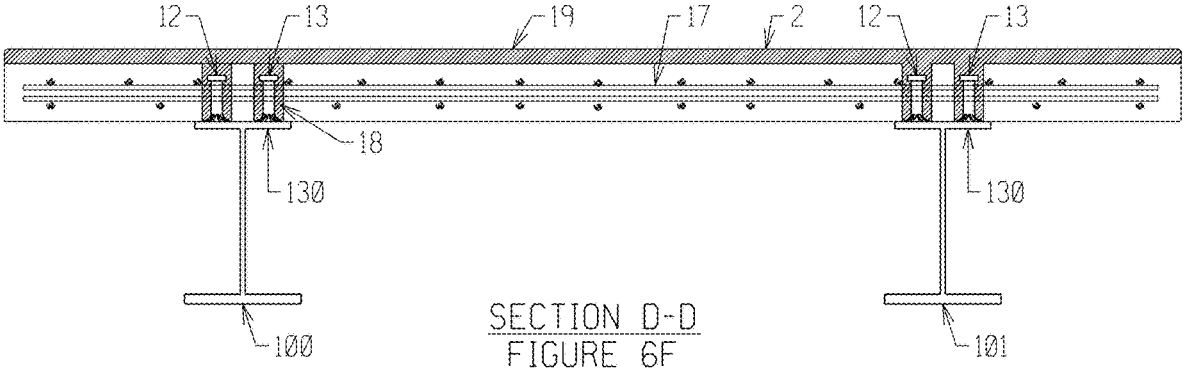
FIG. 6F is an alternate aspect of FIG. 6E wherein the cementitious grout is atop the deck elements and within the grout pockets.

Referring to FIG. 6F, an alternate aspect of the view along section D-D of the prefabricated, prestressed module 2 with I-beam shaped steel beams 100, 101 of FIG. 6D is shown. In the depicted aspect of FIG. 6F, shims 9 are not included.

Figure 6G:
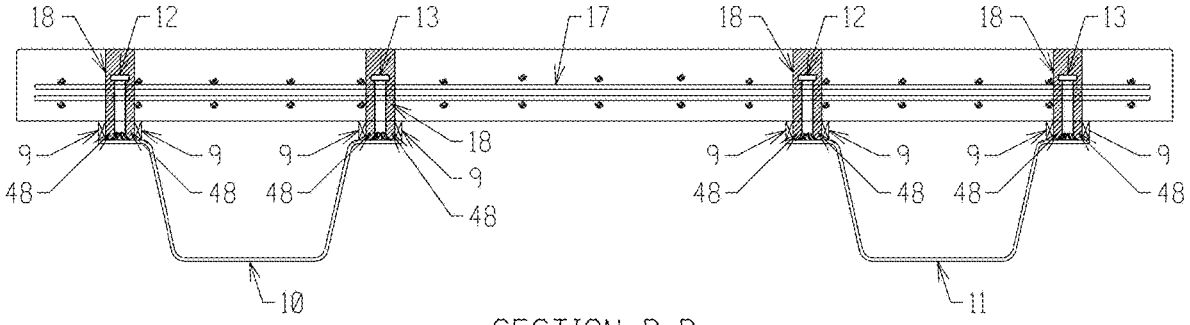
FIG. 6G is a cross-sectional view taken through B-B of FIG. 6 of the prefabricated, prestressed bridge module of FIG. 6 showing the precast deck elements atop the shims and the cementious grout within the grout pockets and between the shims of an aspect of the disclosure.

Referring to FIG. 6G, an alternate aspect of the view along B-B of the prefabricated, prestressed module with trapezoidal U-shape steel beams 10, 11 is shown. In the depicted aspect of FIG. 6G, grout is in the pockets 18 and the annular recesses 48.

Figure 6H:
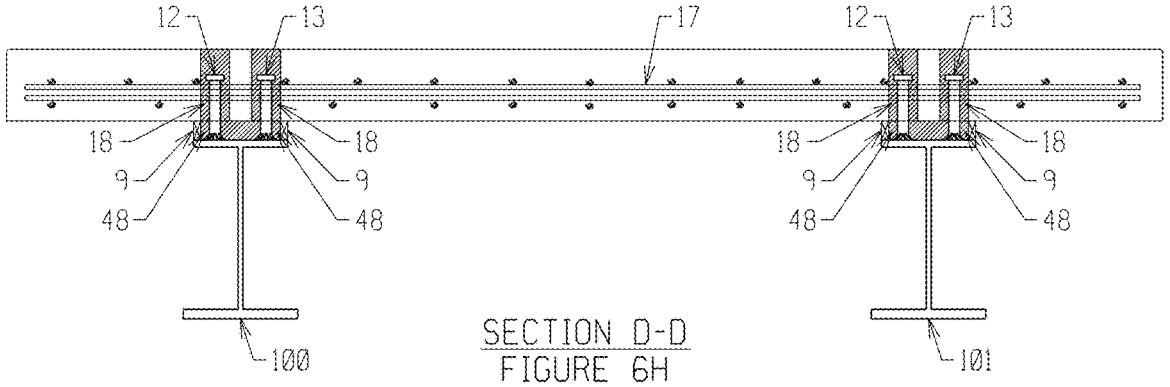
FIG. 6H is a cross-sectional view taken through D-D of FIG. 6D of the prefabricated, prestressed bridge module of FIG. 6D showing the precast deck elements atop the shims and the cementious grout within the grout pockets and between the shims of an aspect of the disclosure.

Referring to FIG. 6H, an alternate aspect of the view along H-H of the prefabricated, prestressed module with I-beam shape steel beams 100, 101 is shown. In the depicted aspect of FIG. 6H, grout is in the pockets 18 and the annular recesses 48.

Figure 7:
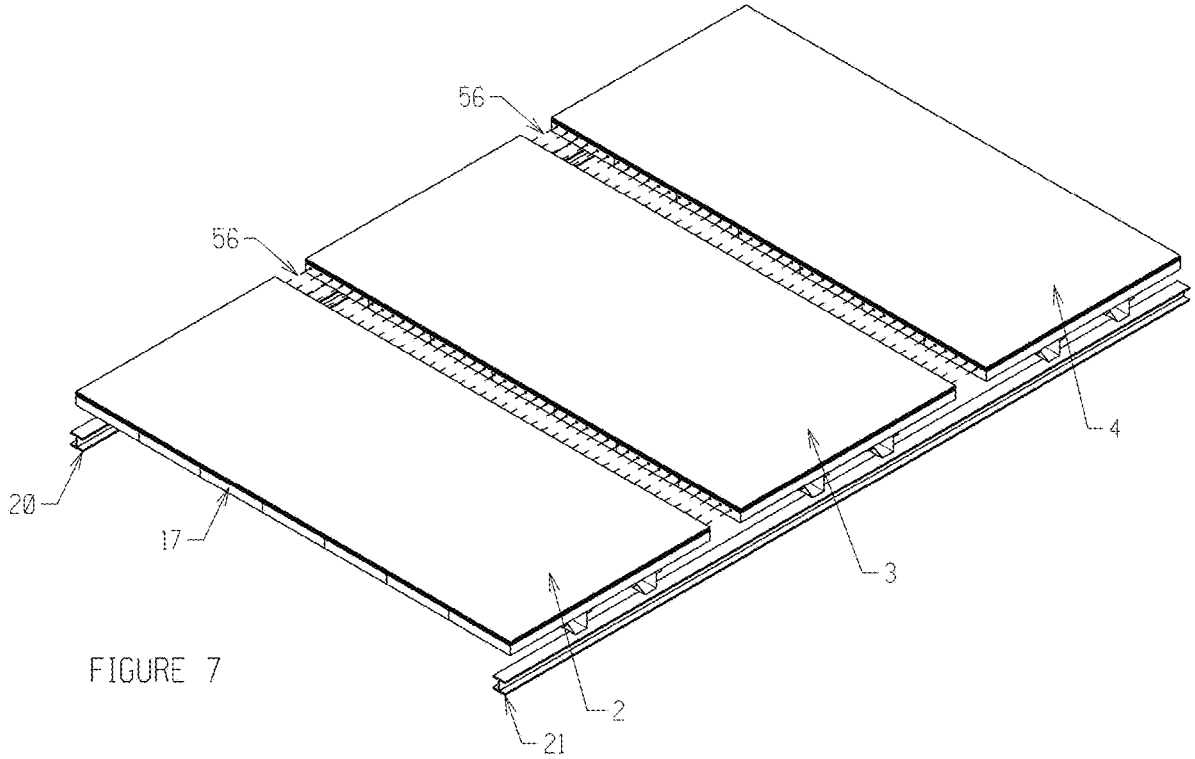
FIG. 7 is a perspective view of a prefabricated, prestressed bridge system consisting of three prefabricated, prestressed bridge modules arranged for joining with cementitious grout.
Figure 8:
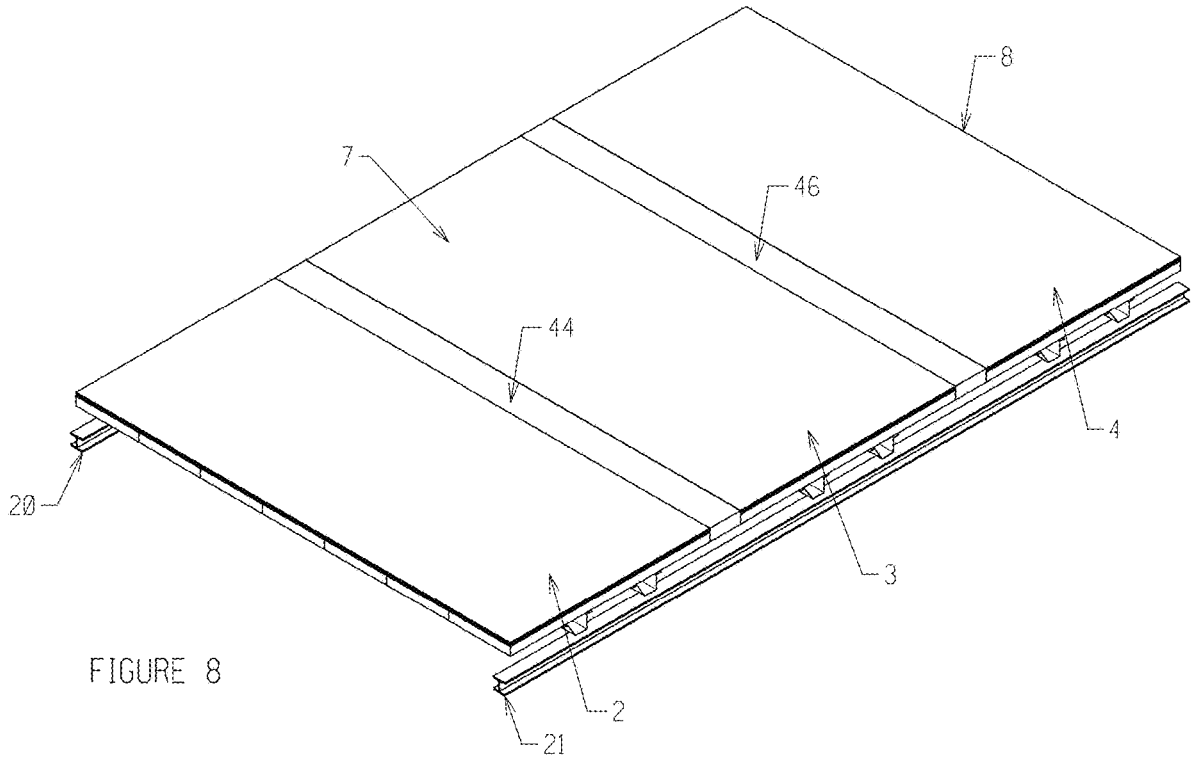
FIG. 8 is a perspective view of a prefabricated, prestressed bridge system consisting of three prefabricated, prestressed bridge modules joined with cementitious grout used in FIG. 7.

Referring to FIGS. 7-8, the process of forming a prefabricated, prestressed bridge system 8 is shown. The prefabricated, prestressed bridge module 2 and the prefabricated, prestressed bridge modules 3 and 4 form a prefabricated, prestressed bridge system 8. Each prefabricated, prestressed, bridge module 2, 3, and 4 is placed atop supports. In the depicted aspect, the supports are support beams 20, 21.

FIG. 7 shows the prefabricated, prestressed bridge modules 2, 3, and 4 placed on support beams 20, 21 and a plurality of reinforcements 56 protruding from the deck elements 17 of bridge modules 2, 3 and 4. FIG. 8 shows a cast in place method of connecting the three prefabricated, prestressed bridge modules 2, 3, and 4 to create a prefabricated, prestressed bridge system 8. FIG. 8 shows cast in place connection 44 poured between module 2 and module 3 and cast in place connection 46 poured between module 3 and module 4. The cast in place connections 44, 46 can be concrete or cementitious grout. With reference to FIGS. 7 and 8, the cast in place connections 44, 46 are poured so that they are approximately the same concrete depth as the deck elements of modules 2, 3, and 4.

An alternate aspect may be made by utilizing steel beams that have a different shape than the depicted trapezoidal steel beams 10, 11. The alternate aspect utilizes steel beams that are in an "I-beam" shape that is commonly used in the construction industry. FIGS. 2B, 2C, 6D, 6E, and 6F depict steel beams 100, 101 that have an I-beam shape. In addition to trapezoidal-shaped steel beams 10, 11 and I-beam shaped steel beams 100, 101, other steel beam shapes commonly used in the construction industry may be used.

An alternate aspect may be made by utilizing beams 10, 11 that are of different material than steel.

An alternate aspect may be made by utilizing deck elements 17 that are of different material than concrete.

An alternate aspect may be made by utilizing grout 36 that is made of different material than cement.

Figure 9:
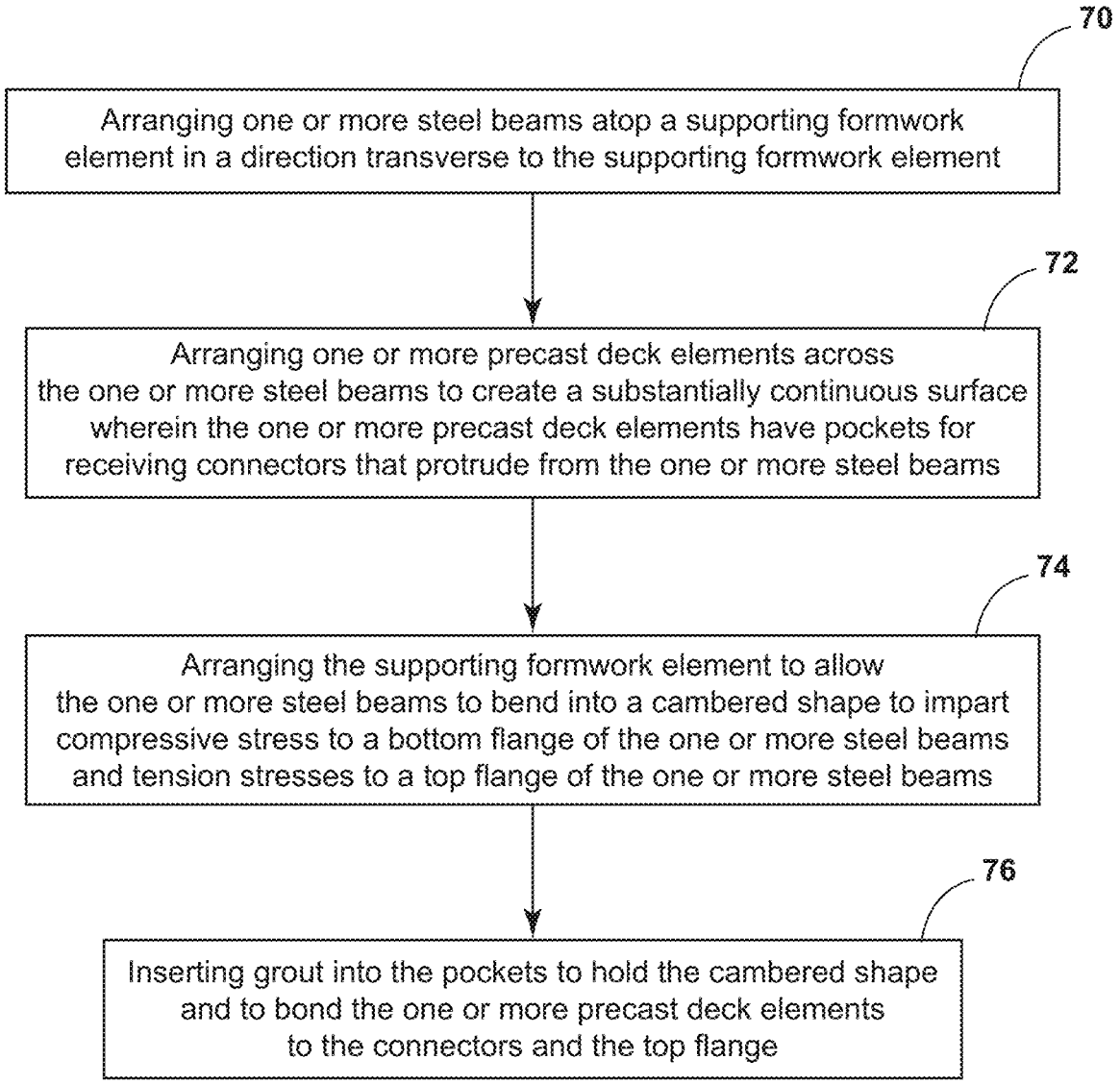
FIG. 9 is a flow diagram of a method for making a prefabricated, prestressed module.

With reference to FIG. 9, a method for making a prefabricated, prestressed module of an aspect of the disclosure is shown. Step 70 provides for arranging one or more steel beams atop a supporting formwork element in a direction transverse to the supporting formwork element. Step 72 provides for arranging one or more precast deck elements across the one or more steel beams to create a substantially continuous surface wherein the one or more precast deck elements have pockets for receiving connectors that protrude from the one or more steel beams. Step 74 provides for arranging the supporting formwork element to allow the one or more steel beams to bend into a cambered shape to impart compressive stress to a bottom flange of the one or more steel beams and tension stresses to a top flange of the one or more steel beams. The combination of the grout 36 and the precast deck elements 17 maintains the camber of the steel beams 10, 11 by maintaining the top flange 30, 32 in a state of tension. The grout 36 between adjacent precast deck elements 17 prevents movement of the precast deck elements 17 toward one another that might otherwise relieve the tension in the top flange 30, 32. Step 76 provides for inserting grout into the pockets to hold the cambered shape and to bond the one or more precast deck elements to the connectors and the top flange. It should be understood that step 72 can occur after step 74.

In various aspects of the disclosure, the prefabricated, prestressed bridge system 8 can be used in a variety of construction applications including, but not limited to, bridge applications. The prefabricated, prestressed bridge system 8 includes one or more prefabricated, prestressed bridge modules 2, 3, and 4 fabricated from different prefabricated elements of varying strengths and modulus of elasticity. The different materials used for the elements are designed to minimize the material quantities of each specific element, minimize the fabrication duration, maximize the strength of the final products and meet any specific need of the final prefabricated, prestressed bridge system.

In one aspect of the present disclosure, a method for making the prefabricated, prestressed bridge module 2 comprises providing and arranging one or more steel beams 10, 11 on three or more supporting formwork elements 14, 15, 16 such that the first supporting formwork element 14 is at a first outer end of the one or more steel beams 10, 11, the second supporting formwork element 15 is at the middle of the one or more steel beams 10, 11, the third supporting formwork element 16 is at a second outer end of the one or more steel beams 10, 11, and the additional formwork elements are at one or more intermediary locations between the first outer end and the middle of the one or more steel beams and at one or more intermediary locations between the second outer end and the middle of the one or more steel beams. The method further comprises welding shear connectors 12, 13 to the top flanges 30, 32 of the one or more steel beams 10, 11, adjusting the height of one or more of the supporting formwork elements 14, 15, 16 to allow bending of the one or more steel beams under the self-weight, weight of the precast concrete deck elements 17 and an externally applied load F, placing and connecting the precast concrete deck elements 17 by means of a ultra-high performance cementitious grout 36 with a compressive strength of at least 14,500 psi and modulus of elasticity of at least 6,300 ksi placed into pockets 18 in the precast deck elements 17 aligned with and containing the welded shear studs and also placed atop the precast concrete deck elements 17 to form an overlay 19 bonded to the top of the precast concrete deck panels 17, such that the resulting compression stress of the concrete deck 42 and overlay 19 secure in place the stresses imparted to the one or more steel beams 10, 11 and creates a completed module 2 having an increased load carrying capacity with less material and at a reduced cost as compared with current practice.

Each prefabricated, prestressed bridge module 2, 3, 4, comprising of one or more steel beams 10, 11, shear connectors 12, 13 attached to the one or more steel beams 10, 11, and connecting the precast concrete deck elements 17 to the beams 10, 11 to form a surface 38 atop the beams 10, 11, then forms a prefabricated, prestressed bridge system 8 comprising two or more prefabricated, prestressed bridge modules 2, 3, 4, secured together with ultra-high performance concrete joints 44, 46 is also a subject of the present disclosure.

Accordingly, an object of the present disclosure is to provide a prefabricated, prestressed bridge module 2 in which camber is produced by selectively varying the heights H of one or more supporting formwork elements 14, 15, 16 under the bridge module 2 components while the prefabricated, prestressed bridge module 2 is being made. Alternatively, camber may be achieved by selectively raising one or more supporting formwork elements 14, 15, 16 under the bridge module components while the prefabricated, prestressed bridge module 2 is being made.

It is an additional object of this disclosure to provide a prefabricated, prestressed bridge module 2 which utilizes the weight of precast deck elements 17 placed atop the steel beams 10, 11 in combination with the adjustment of supporting formwork elements 14, 15, 16 to produce camber.

It is an additional object of this disclosure to provide a prefabricated, prestressed bridge module 2 which uses the weight of deck panels precast deck elements 17 placed atop the steel beams 10, 11, the varying height (H) supporting formwork elements 14, 15, 16 and an externally applied load (F) to produce camber.

It is an additional object of this disclosure to provide a prefabricated, prestressed bridge module 2 which uses the weight of deck panels (precast deck elements 17) placed atop the beams, the varying height supporting formwork elements 14, 15, 16 to produce camber in the steel beam 10, 11 that is secured in place with shear connection between the deck panels (precast deck elements 17) and steel beams 10, 11.

It is an additional object of this disclosure to provide a prefabricated, prestressed bridge module 2 which uses precast concrete deck panels (precast deck elements 17) placed atop high density polyethylene shims 9 with compressive strength of at least 40 psi which are placed atop the top flanges 30, 32 of the steel beams 10, 11 which allow for an annular space 48 between the precast deck panel (precast deck elements 17) and steel beams 10, 11.

It is an additional object of this disclosure to provide a prefabricated, prestressed bridge module 2 which uses precast concrete deck panels (precast deck element 17) placed atop the beams that are secured in place with shear connections between the deck panels (precast deck element 17) and steel beams 10, 11 comprising of cementitious grout 36 bonded to the top of the steel beams 10, 11 and bottom of the concrete deck panels (precast deck element 17).

It is an additional object of this disclosure to provide a prefabricated, prestressed bridge module 2 which uses precast concrete deck panels (precast deck element 17) placed atop the steel beams 10, 11 that are secured in place with cementitious grout placed in the annular void (annular space 48) between the steel beams 10, 11 and the precast deck panels (precast deck element 17).

It is an additional object of this disclosure to provide a prefabricated, prestressed bridge module 2 which uses precast concrete deck panels (precast deck element 17) placed atop the beams 10, 11 that are secured in place with shear connection 12, 13 between the deck panels (precast deck elements 17) and steel beams 10, 11 comprising of cementitious grout 36 being integrally placed with an overlay 19 surface atop the precast concrete deck panels (precast deck elements 17).

It is an additional object of the disclosure to provide a prefabricated, prestressed bridge module 2 which utilizes steel beams 10, 11 that are trapezoidal-shaped (10, 11), I-beam-shaped (100, 101), or shaped like other steel beams commonly used in the civil engineering industry.

It is an additional object of the disclosure to provide a prefabricated, prestressed bridge system 8 that is faster to make, more efficient to fabricate, faster to install and more affordable than other prefabricated, prestressed bridges 1.

It is an additional object of the disclosure to provide a prefabricated, prestressed bridge system 8 that consists of one or more prefabricated, prestressed bridge modules 2 that can be joined with one another to make prefabricated, prestressed bridge systems 8 of various sizes.

It is an additional object of the disclosure to provide a method of making a prefabricated, prestressed bridge system 8 that can be made in a first location and delivered to a second location for installation and use.

It is an additional object of the disclosure to provide a method of making a prefabricated, prestressed bridge system 8 in which the components can be manufactured in separate locations and delivered to a common location for assembly, installation and use.

An additional object of the disclosure is to provide a prefabricated, prestressed bridge system 8 that can serve as a prefabricated, prestressed beam that can be used in a variety of construction applications, including but not limited to bridge applications.

It is an additional advantage of utilizing connections 44, 46 between modules 2, 3, 4, with ultra-high performance concrete and making them more economical, faster to fabricate, and easier to install.

An additional advantage of this disclosure is a modular system which is lighter in weight than other systems, can be fabricated in a location other than its final use and easily moved and installed in its final location.

It is an additional object of the disclosure to provide shear force transfer from the beam elements (steel beams 10, 11) to the deck panel elements (precast deck element 17) that utilizes roughened surfaces on top of the beams 10, 11 and bottom of the deck panels (precast deck element 17) which are then bonded with ultra-high performance concrete.

The principle objective of the disclosure is to provide a more economical bridge system with an improved configuration that allows the final bridge element to have a longer service life than current conventional materials and procedures.

Another objective of this disclosure is to provide a method for making the bridge element which reduces the in place stresses imparted to each individual element.

It is an additional object of the disclosure to provide a geometric configuration that utilizes and economizes the properties of the specific materials used to fabricate the bridge.

It is an additional object of the disclosure to provide a protective coating of the beam elements that enables the bridge to have an even longer service life in environments typically encountered.

It is an additional object of the disclosure to utilize cold formed steel which has the advantage of reduced cost over current fabrication of steel girders.

Another advantage is the ease of construction installation that speeds installation and reduces end-user delays when compared with current practice.

Another objective is to utilize newly develop cementitious materials to further ease fabrication and speed installation.

The present innovations are improvements (and have advantages over) known similar bridge systems such as shown in Nelson U.S. Pat. No. 7,600,283 "Prefabricated, Prestressed Bridge System and Method of Making Same," including at least the following:

The UHPC overlay 19 provides an additional 40 years of maintenance free service life to the bridge deck surface (longer service life, lower life cycle costs).

The UHPC overlay 19 allows for thinner precast concrete deck panels (less concrete material, shallower overall depth of module).

The UHPC fill in the precast concrete panel voids (pocket 18) allows for larger spacing of the welded shear connectors (less shear connector material, lower cost).

The top of the precast concrete deck panels (precast deck element 17) will have a roughened surface with an amplitude of at least ¼" so that the IHPC overlay will bond to the precast concrete panel and provide additional stiffness to the bridge module (shallower overall depth of module).

The UHPC overlay 19 is extremely dense and impermeable giving further protection and longer service life to the underlying precast concrete deck panel (precast deck element 17) (longer service life, lower life cycle costs).

The UHPC placed into the annular space 48 between the top of the steel beams 10, 11 and the bottom of the precast concrete deck panel (precast deck element 17) provides additional bonding and shear resistance further strengthening the final bridge module 2 (this option would eliminate shear connectors, lower cost).

The UHPC overlay 19 places an extremely stiff, dense and impermeable layer at the top extreme fiber of the bridge module allowing for shallower modules, which is a benefit not only for decreased weight in shipping, but increase clearance for bridges and less tall structures for buildings (shallower overall depth of module).

The use of precast concrete deck panels (precast deck elements 17) (rather than casting wet concrete on steel beam) allows for flexibility of the fabrication process. Material can be allocated and manufactured in parallel rather than in series (faster fabrication, lower cost).

The use of the weight of the precast concrete deck panels (precast deck elements 17) for providing camber in the steel beams 10, 11 allows for the elimination of backwalls and intermediate diaphragms (faster fabrication, lower cost).

The use of UHPC in the joint 44, 46 to connect individual modules 2, 3, 4, increases the load carrying capacity of the joint, reduces the width of the joint, speed of the installation of the modules and allows for the connected modules to support load sooner (faster installation, reduced material).

In various aspects of the device, the shear connectors 12, 13 may be preset in the precast deck elements 17. In one aspect, the precast deck elements 17 may be arranged over one or more steel beams 10, 11 atop supporting formwork elements 14, 15, and 16 in a direction transverse to the supporting formwork elements 14, 15, and 16. The one or more precast deck elements 17 may be arranged across the one or more steel beams 10, 11 creating a substantially continuous surface 38. In various aspects, the one or more precast deck elements 17 have connectors 12, 13 that extend between the one or more steel beams 10, 11 and the one or more precast deck elements 17. The supporting formwork elements 14, 15, 16 support the one or more steel beams 10, 11 while bent into a cambered shape 28 resulting in compressive stresses to a bottom flange 34 of the one or more steel beams 10, 11 and tension stresses to a top flange 30, 32 of the one or more steel beams 10, 11. The grout 36 is disposed on the one or more steel beams 10, 11 and at least between adjacent precast deck elements 17 of the one or more precast deck elements 17 wherein the grout 36 bonds the one or more precast deck elements 17 together and maintains the cambered shape 28 of the one or more steel beams 10, 11.

Weld plates may be beneath the shear connectors 12, 13 to allow for welding of the shear connectors 12, 13 to the steel beams 10, 11 via the weld plates. Grout 36 may be inserted between the deck elements 17 and as an overlay 19 over one or more deck elements 17. In another aspect, the overlay 19 may be omitted, and grout 36 may be inserted into the pockets, such as between the deck elements 17. The grout 36 is the primary means for keeping camber in steel beams 10, 11. Retention of camber by the grout 36 can be at least partially supplemented by the welds between the weld plates attached to the shear connectors 12, 13 and the steel beams 10, 11.

It is to be understood that variations and modifications can be made on the aforementioned structure without departing from the concepts of the present disclosure, and further it is to be understood that such concepts are intended to be covered by the following claims unless these claims by their language expressly state otherwise.

The disclosure claimed is:

1. A prefabricated, prestressed bridge-forming module comprising:

one or more steel beams atop an inner supporting formwork element and a pair of outer supporting formwork elements in a direction transverse to the inner supporting formwork element and the pair of outer supporting formwork elements;

two or more precast deck elements across and above a top flange of each of the one or more steel beams and including first and second precast deck elements disposed above each of the pair of outer supporting formwork elements creating a substantially continuous surface and exerting a downward compressive load on the one or more steel beams, the two or more precast deck elements having couplings that extend between the top flange of the one or more steel beams and the two or more precast deck elements;

the inner supporting formwork element and the pair of outer supporting formwork elements supporting the one or more steel beams while bent into a cambered shape resulting in compressive stresses to a bottom flange of the one or more steel beams and tension stresses to the top flange of the one or more steel beams; and grout disposed on the one or more steel beams and at least between adjacent precast deck elements of the two or more precast deck elements, wherein the grout bonds the two or more precast deck elements together and, together with the downward compressive load exerted by the two or more precast deck elements on the one or more steel beams, maintains the cambered shape of the one or more steel beams.

2. The prefabricated, prestressed bridge-forming module of claim 1, wherein the prefabricated, prestressed bridge-forming module is one of a plurality of prefabricated, prestressed bridge-forming modules arranged to form a surface of a bridge.

3. The prefabricated, prestressed bridge-forming module of claim 1, further comprising:

an overlay disposed atop the two or more precast deck elements.

4. The prefabricated, prestressed bridge-forming module of claim 3, wherein the overlay forms a concrete surface bonded to the two or more precast deck elements.

5. The prefabricated, prestressed bridge-forming module of claim 1, wherein at least one of the two or more precast deck elements includes concrete.

6. The prefabricated, prestressed bridge-forming module of claim 1, wherein at least one of the one or more steel beams includes a roughened top surface and wherein at least one of the two or more precast deck elements includes a roughened bottom surface.

7. The prefabricated, prestressed bridge-forming module of claim 6, wherein the roughened top surface and the roughened bottom surface provide shear force transfer from the at least one of the one or more steel beams to the at least one of the two or more precast deck elements when they are bonded with concrete.

8. The prefabricated, prestressed bridge-forming module of claim 1, wherein the two or more precast deck elements include two or more panels.

9. The prefabricated, prestressed bridge module of claim 1, wherein the couplings include shear connectors extending from the one or more steel beams.

10. The prefabricated, prestressed bridge module of claim 1, wherein the couplings include Ultra High Performance Concrete.

11. The prefabricated, prestressed bridge module of claim 1, wherein the two or more precast deck elements include a third precast deck element disposed above the inner supporting formwork element.

12. A prefabricated, prestressed bridge-forming module comprising:

at least one steel beam bent into a cambered shape and having at least one top flange and disposed atop an inner supporting formwork element and a pair of opposing outer supporting formwork elements disposed proximate ends of the at least one steel beam in a direction transverse to the supporting formwork element;

a plurality of panels including an inner panel and a pair of opposing outer panels disposed atop the at least one top flange of the at least one steel beam and above the respective inner supporting formwork element and the pair of opposing outer supporting formwork elements, each panel of the plurality of panels including grout pockets for receiving connectors protruding from the at least one top flange of the at least one steel beam; and grout disposed between the plurality of panels and in the grout pockets of the plurality of panels to form a substantially continuous surface, wherein the plurality of panels disposed atop the at least one top flange of the at least one steel beam exert a downward compressive load on the at least one top flange of the at least one steel beam to bend the at least one steel beam into a predetermined cambered shape and wherein the grout, when cured, maintains the at least one steel beam in the predetermined cambered shape.

13. A method of making a prefabricated, prestressed module comprising:

arranging one or more steel beams atop a supporting formwork element in a direction transverse to the supporting formwork element;

arranging a pair of outer panels and an inner panel across and above a top flange of the one or more steel beams so that each of the pair of outer panels are proximate ends of each of the one or more steel beams and the inner panel is proximate a middle of the one or more steel beams to exert a compressive load on the one or more steel beams and to form a predefined camber in the one or more steel beams; and disposing grout between the inner panel and each of the pair of outer panels to maintain the predefined camber in the one or more steel beams.

14. The method of making a prefabricated, prestressed module of claim 13, further comprising:

disposing an overlay over the pair of outer panels, the inner panel, and the grout.

15. The method of making a prefabricated, prestressed module of claim 13, further comprising:

applying an external load proximate ends of each of the one or more steel beams to exert a compressive load on the one or more steel beams to camber the one or more steel beams; and removing the external load from the ends of each of the one or more steel beams.

16. The method of making a prefabricated, prestressed module of claim 15, wherein applying the external load proximate the ends of each of the one or more steel beams to exert the compressive load on the one or more steel beams to camber the one or more steel beams precedes arranging the pair of outer panels and the inner panel across and above a top flange of the one or more steel beams so that each of the pair of outer panels are proximate the ends of each of the one or more steel beams and the inner panel is proximate a middle of the one or more steel beams to exert the compressive load on the one or more steel beams and to form the predefined camber in the one or more steel beams.

17. The prefabricated, prestressed bridge-forming module of claim 12, wherein the inner panel and the pair of opposing outer panels each include a substantially flat bottom surface disposed atop the at least one top flange of the at least one steel beam.

18. The prefabricated, prestressed bridge-forming module of claim 12, wherein the grout is disposed between the inner panel and each of the pair of opposing outer panels and in the grout pockets with a monolithic pour.

19. The prefabricated, prestressed bridge-forming module of claim 12, further comprising:

an overlay disposed over the substantially continuous surface, wherein the overlay maintains the at least one steel beam in the predetermined cambered shape.

20. The prefabricated, prestressed bridge-forming module of claim 12, wherein the plurality of panels include two concrete panels.

* * * * *